US007347739B2

(12) United States Patent
Cox

(10) Patent No.: US 7,347,739 B2
(45) **Date of Patent: *Mar. 25, 2008**

(54) DEVICES, SYSTEMS, AND METHODS FOR COUPLING ELECTRICAL WIRING

(75) Inventor: Ned Cox, Gray, TN (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/430,762

(22) Filed: May 9, 2006

(65) Prior Publication Data

US 2006/0258231 A1 Nov. 16, 2006

Related U.S. Application Data

(60) Provisional application No. 60/679,854, filed on May 11, 2005.

(51) Int. Cl.
*H01R 9/22* (2006.01)

(52) U.S. Cl. ..... 439/709

(58) Field of Classification Search ..... 439/709, 439/712, 811, 812

See application file for complete search history.

(56) References Cited

U.S. PATENT DOCUMENTS

| | | | | |
|---|---|---|---|---|
| 3,930,706 | A * | 1/1976 | Obuch et al. | 439/249 |
| 4,082,407 | A * | 4/1978 | Smorzaniuk et al. | 439/487 |
| 4,103,986 | A * | 8/1978 | Izraeli | 439/811 |
| 4,239,324 | A * | 12/1980 | Stenz | 439/716 |
| 4,553,801 | A * | 11/1985 | Zajeski | 439/595 |
| 5,041,023 | A * | 8/1991 | Lytle | 439/637 |
| 7,029,336 | B2 * | 4/2006 | Cox | 439/709 |
| 7,048,591 | B1 * | 5/2006 | Chiang | 439/709 |
| 7,074,054 | B2 * | 7/2006 | Mertz et al. | 439/78 |
| 2005/0112955 | A1 * | 5/2005 | Buckley et al. | 439/727 |

FOREIGN PATENT DOCUMENTS

| | | |
|---|---|---|
| DE | 9418138 U1 | 2/1996 |
| WO | WO2004/107503 | 12/2004 |

* cited by examiner

*Primary Examiner*—Neil Abrams
*Assistant Examiner*—Phuongchi Nguyen

(57) ABSTRACT

Certain exemplary embodiments comprise a connector, which can define a plurality of cages. The plurality of cages can define a plurality of cage openings. The connector can comprise a plurality of pins, which can be disposed in an alternating proximal-distal relationship with respect to the co-planar plurality of cage openings.

18 Claims, 6 Drawing Sheets

DEVICES, SYSTEMS, AND METHODS FOR COUPLING ELECTRICAL WIRING

CROSS-REFERENCES TO RELATED APPLICATIONS

This application claims priority to, and incorporates by reference herein in its entirety, pending U.S. Provisional Patent Application Ser. No. 60/679,854, filed 11 May 2005.

BACKGROUND

A connector, such as a terminal block can be used to connect inputs and outputs of programmable logic controllers (PLCs). For ease of use to connect wires, connectors can comprise two or more parts. In certain exemplary embodiments, a first part can be soldered on and/or to a printed circuit board (PCB). In certain exemplary embodiments, a second part can be detachable from the first part. Connectors can be composed of a flame retardant resin and can comprise internal metal cages to facilitate a connection of wires.

PLC users can desire that manufacturers of PLCs decrease one or more dimensions and therefore a footprint of a PLC while providing sufficient power dissipation. In order to compress the dimensions of a PLC, a length of a connector can be reduced. For example, a pitch of screw terminals provided on a connector can influence a total length of the connector. In certain exemplary embodiments, the pitch of a connector can be approximately 5.08 mm. If terminal block length decreases an increase airflow can be desirable within the terminal block area to compensate for the decrease in unit length and a related increase in higher internal temperatures. Hence, exemplary embodiments of certain devices, systems, and/or methods for coupling electrical wiring to a PCB are disclosed.

SUMMARY

Certain exemplary embodiments comprise a connector, which can define a plurality of cages. The plurality of cages can define a plurality of cage openings. The connector can comprise a plurality of pins, which can be disposed in an alternating proximal-distal relationship with respect to the co-planar plurality of cage openings.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DEFINITIONS

Figure 1:
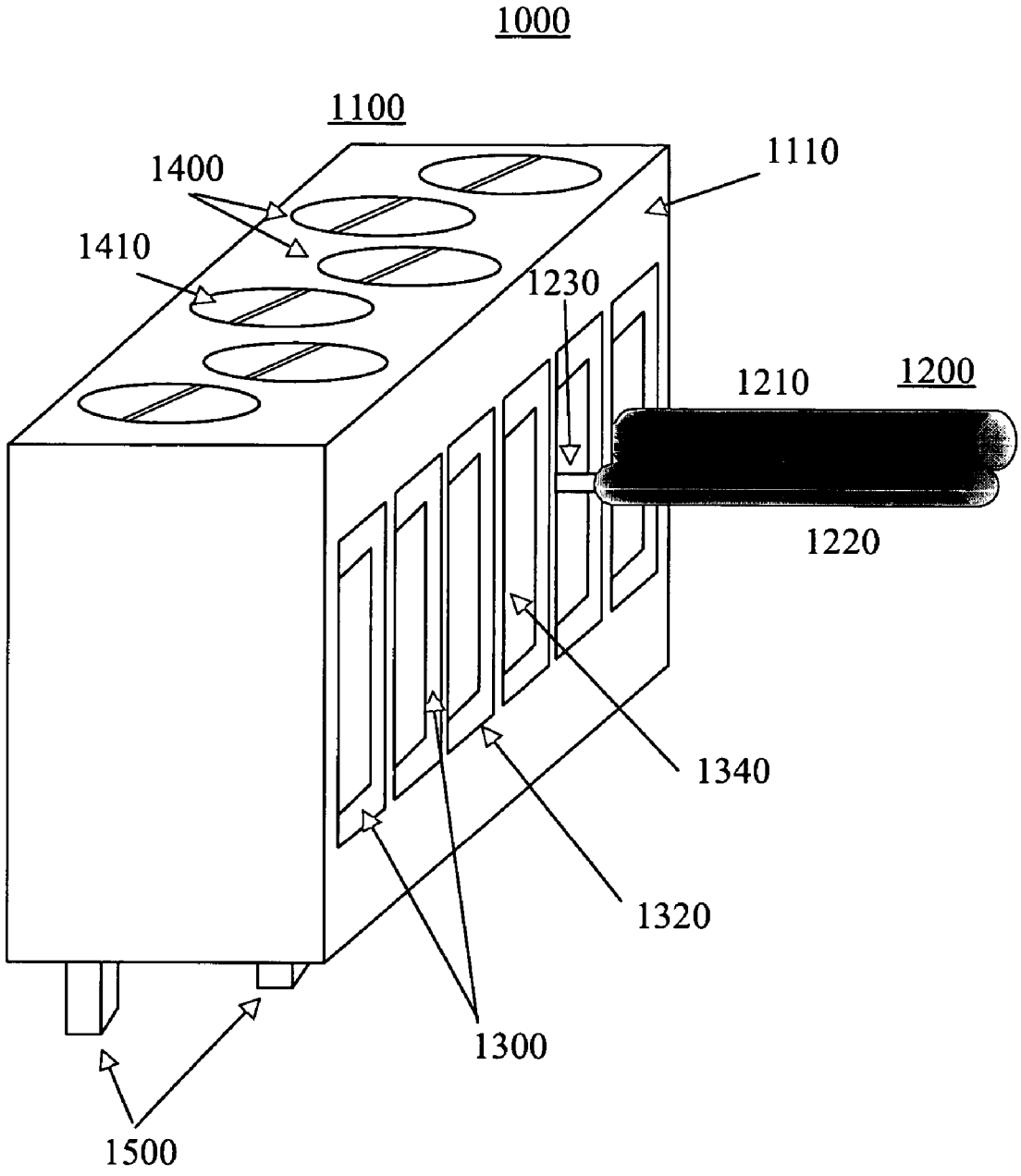
FIG. 1 is a perspective view of an exemplary embodiment of a system 1000.

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof.

adapter—a device used to effect operative compatibility between different parts of one or more pieces of an apparatus or system.

air flow—a movement of a mass of atmospheric gas.

all—every member of a defined set.

alternating proximal-distal relationship—a staggered pattern comprising one that is located toward the front, followed by another that is located toward the back, and then repeating.

and/or—either in conjunction with or in alternative to.

apparatus—an appliance or device for a particular purpose.

apply—to put to use for a purpose.

approximately—nearly the same as.

associate—to join, connect together, and/or relate.

associated with—related to.

attach—to fasten, secure, and/or join.

axially restrained screw—a screw that does not substantially advance or retreat along the screw's longitudinal axis when the screw is rotated.

base—a portion of a connector adapted to be connected directly to a printed circuit board.

cage—a partially open box or enclosure.

can—is capable of, in at least some embodiments.

cap—a portion of a connector adapted to be directly connected to a plurality of wires via a plurality of cages.

cause—to produce an effect.

centerline—a line that bisects a figure.

clamp—n. a device used to join, grip, support, and/or compress. v. to join, grip, support, and/or compress.

co-linear—lying or occurring in a same line with.

comprising—including but not limited to.

configure—to make suitable or fit for a specific use or situation.

configured to—capable of performing a particular function.

connect—to join or fasten together.

connector—a device configured to electrically couple a plurality of wires to a printed circuit board.

convert—to transform, adapt, and/or change.

co-planar—lying or occurring in the same plane.

correspond—to be associated with.

couple—to join, connect, and/or link together.

coupleable—capable of being joined, connected, and/or linked together.

coupling—linking in some fashion.

create—to bring into being.

deadline—a time interval during which an activity's completion has more utility to a system, and after which the activity's completion has less utility. Such a time interval might be constrained only by an upper-bound, or it might be constrained by both upper and lower bounds.

define—to establish the outline, form, or structure of.

determine—to obtain, calculate, decide, deduce, and/or ascertain.

device—a machine, manufacture, and/or collection thereof.

dimension—size.

dispose—to position or locate.

each—every one of a group considered individually.

electrical—pertaining to electricity.

electrical path—a conductive circuit.

energy—usable power.

facilitate—to help bring about.

form—to create.

freely accessible—able to be reached without substantial impediment or interference.

gage—the American Wire Gage measurement of wire diameter.

hard deadline—the special case where completing an activity within the deadline results in the system receiving all the utility possible from that activity, and completing the activity outside of the deadline results in zero utility (i.e., resources consumed by the activity were wasted, such as when one travels to the beach to photograph a sunrise on a particular day and arrives after the sun has already arisen) or some negative value of utility (i.e., the activity was counter-productive, such as when firefighters enter a burning building to search for a missing person seconds before the building collapses, resulting in injury or death to the firefighters). The scheduling criterion for a hard deadline is to always meet the hard deadline, even if it means changing the activity to do so.

hard real-time—relating to a system (or sub-system) having activities with hard deadlines, and a sequencing goal of always meeting all those hard deadlines. A system operating in hard real-time can suffer a critical failure if time constraints are violated. A classic example of a hard real-time computing system is an automobile engine electronic valve timing control system, in which an overly delayed or overly advanced control signal might cause engine failure or damage, due to one or more valve-piston collisions. Systems operating in hard real-time typically utilize instructions embedded in hardware and/or firmware.

housing—an enclosing, covering, protecting, and/or supporting frame, box, and/or chassis.

install—to connect or set in position and prepare for use.

insulation—an electrically non-conductive coating.

jaw—either of two hinged parts in a mechanical device.

line—a geometric figure formed by a point moving along a fixed direction and the reverse direction.

manage—to direct or control.

may—is allowed and/or permitted to, in at least some embodiments.

metallic—composed substantially of one or more metals.

method—a process, procedure, and/or collection of related activities for accomplishing something.

movable—capable of motion relative to an object of reference.

non-destructively—of, relating to, or being a process that does not result in damage to the subject material and/or product.

obtain—to receive, calculate, determine, and/or compute.

opening—a substantially unobstructed entrance.

opposingly disposed—positioned or located so as to be in a position facing something else.

pin—a thin conductive shaft adapted to engage with a printed circuit board.

plane—a two-dimensional surface.

plurality—the state of being plural and/or more than one.

predetermined—established in advance.

prevent—to keep an event from happening.

printed circuit board—a substantially planar board onto which electrical components are mechanically and electrically connected.

programmable logic controller (PLC)—a solid-state, microprocessor-based, hard real-time computing system that is used, via a network, to automatically monitor the status of field-connected sensor inputs, and automatically control communicatively-coupled devices of a controlled industrial system (e.g., actuators, solenoids, relays, switches, motor starters, speed drives (e.g., variable frequency drives, silicon-controlled rectifiers, etc.), pilot lights, ignitors, etc.) according to a user-created set of values and user-created logic and/or instructions stored in memory. The sensor inputs reflect measurements and/or status information related to the controlled industrial system. A PLC provides any of: automated input/output control; switching; counting; arithmetic operations; complex data manipulation; logic; timing; sequencing; communication; data file manipulation; control; relay control; motion control; process control; distributed control; and/or monitoring of processes, manufacturing equipment, and/or other automation of the controlled industrial system. In addition to controlling a process, a PLC might also provide control of information, such as via outputting information to speakers, printers, monitors, displays, indicators, etc., and/or rendering information, such as via reports, notifications, and/or alarms, etc., such as via a Human-Machine Interface (HMI). Because of its precise and hard real-time timing and sequencing capabilities, a PLC is programmed using ladder logic or some form of structured programming language specified in IEC 61131-3, namely, FBD (Function Block Diagram), LD (Ladder Diagram), ST (Structured Text language), IL (Instruction List) and/or SFC (Sequential Function Chart), or potentially via a general purpose hard-real-time-aware programming language, such as ADA. Because of its hard real-time timing and sequencing capabilities, a PLC can replace up to thousands of relays and cam timers. PLC hardware often has good redundancy and fail-over capabilities.

provide—to furnish, supply, give, and/or make available.

real-time—a system (or sub-system) characterized by time constraints on individual activities and scheduling criteria for using those time constraints to achieve acceptable system timeliness with acceptable predictability.

receive—to get as a signal, take, acquire, and/or obtain.

recommend—to suggest, praise, commend, and/or endorse.

related to—having a connection with.

relationship—a connection or association.

relative—in comparison with.

releasably—capable of being substantially non-destructively detached.

release—to free from something that binds, fastens, or holds back; to let go.

removably—to be able to move from a place or position occupied.
request—to express a desire for and/or ask for.
screw—a cylindrical rod incised with one or more helical or advancing spiral threads.
screw head—a flared end of a screw.
screw-actuated—to move something based on the rotation of a screw.
screwdriver—a device configured to turn a screw.
select—to make a choice or selection from alternatives.
set—a related plurality.
size—physical dimensions, proportions, magnitude, and/or extent of an object.
snapably—mechanically connectable in manner that produces an audible click upon establishment of an electrical connection.
socket—an opening and/or a cavity into which an inserted part is designed to fit.
soft deadline—a general case where completing the activity by the deadline results in the system receiving a utility measured in terms of lateness (completion time minus deadline), such that there exist positive lateness values corresponding to positive utility values for the system. Lateness can be viewed in terms of tardiness (positive lateness), or earliness (negative lateness). Generally, and potentially within certain bounds, larger positive values of lateness or tardiness represent lower utility, and larger positive values of earliness represent greater utility.
soft real-time—relating to a system (or sub-system) that takes a best efforts approach and seeks to minimize latency from event to response as much as possible while keeping throughput up with external events overall. Such systems will not necessarily suffer a critical failure if time constraints are violated. A classic example is an airline reservations system, which has a target "maximum" response time. All is well if the response is much faster than this "maximum." Further, exceeding the "maximum" is undesirable, but such extended delays can be tolerated up to a point if they do not occur too frequently. As another example, live audio-video systems are usually soft real-time; violation of time constraints can result in degraded quality, but the system typically can continue to operate. Yet another example is a network server, which is a system for which fast response is desired but for which there is typically no deadline. If the network server is highly loaded, its response time may slow with no actual failure in service.
standoffs—protrusions configured to provide a separation of a first object from a second object.
stationary—substantially fixed with respect to an object of reference.
strip—to remove.
substantially—to a great extent or degree.
support—to bear the weight of, especially from below.
system—a collection of mechanisms, devices, data, and/or instructions, the collection designed to perform one or more specific functions.
termination end—a location where a wire no longer continues in any further direction.
threshold—a point that when exceeded produces a given effect or result.
transmit—to convey (force or energy) from one part of a mechanism to another.
via—by way of and/or utilizing.
voltage—an electrical potential.
wire—an electrically conductive metallic strand or rod.
with respect to—in relation with.

DETAILED DESCRIPTION

Certain exemplary embodiments provide a connector, which can define a plurality of cages. The plurality of cages can define a plurality of cage openings. The connector can comprise a plurality of pins, which can be disposed in an alternating proximal-distal relationship with respect to the co-planar plurality of cage openings.

A connector, such as a terminal block can be used to connect inputs and outputs of programmable logic controllers (PLCs). For ease of use to connect wires, connectors can comprise two or more parts. In certain exemplary embodiments, a first part can be soldered on and/or to a printed circuit board (PCB). In certain exemplary embodiments, a second part can be detachable from the first part. Connectors can be composed of a flame retardant resin and can comprise internal metal cages to facilitate a connection of wires.

PLC users can desire that manufacturers of PLCs decrease one or more dimensions and therefore a footprint of a PLC while providing sufficient power dissipation. In order to compress the dimensions of a PLC, a length of a connector can be reduced. For example, a pitch of screw terminals provided on a connector can influence a total length of the connector. In certain exemplary embodiments, the pitch of a connector can be approximately 5.08 mm. If terminal block length decreases, an increase airflow can be desirable within the terminal block area to compensate for the decrease in unit length and a related increase in higher internal temperatures.

Figure 2:
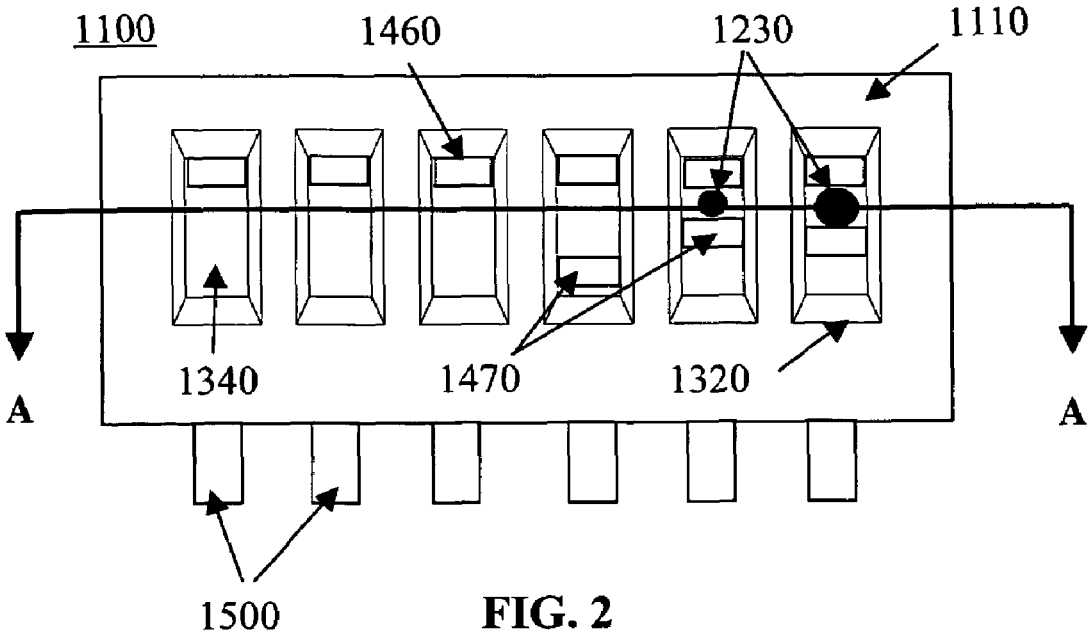
FIG. 2 is a front view of the exemplary embodiment of system 1000.
Figure 3:
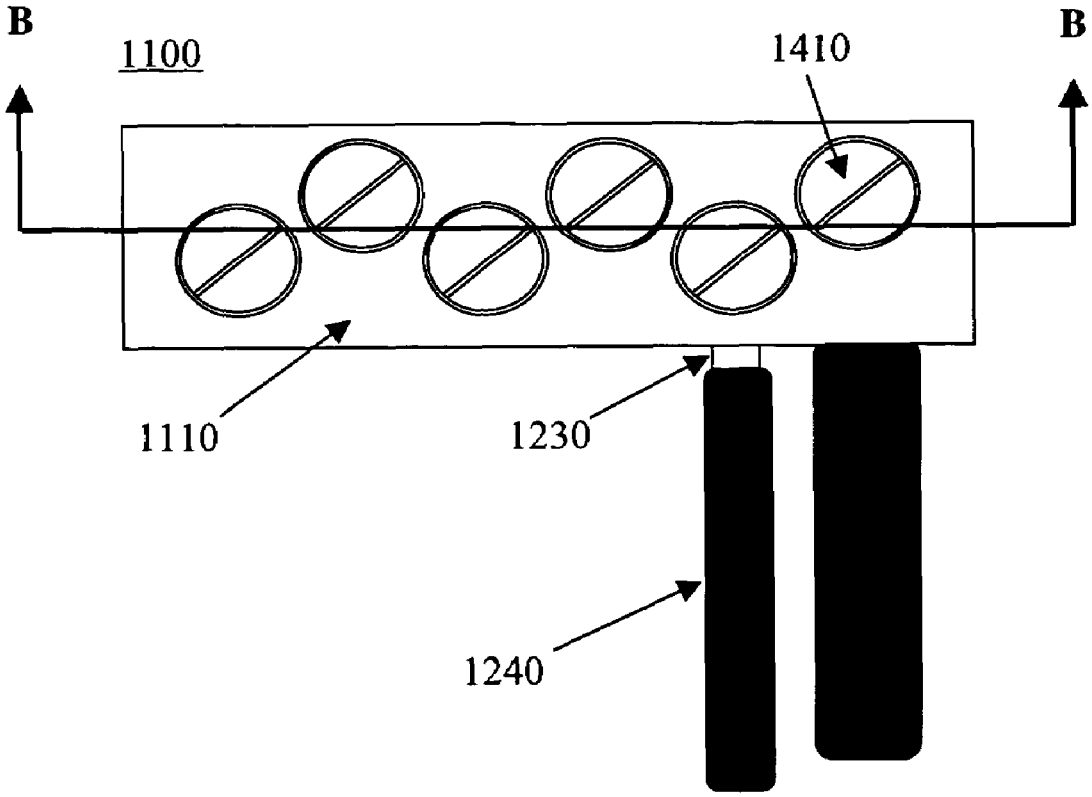
FIG. 3 is a top view of the exemplary embodiment of system 1000.

FIG. 1 is a perspective view, FIG. 2 is a front view, and FIG. 3 is a top view, of an exemplary embodiment of a system 1000, which can be used as a connector 1100 for electrically coupling a plurality of wires 1200 to, for example, an information device, a network interface card, and/or a printed circuit board (PCB), such as a PCB of a programmable logic controller (PLC) and/or any other type of information device. Wires 1200 can convey input signals, output signals, control signals, power, and/or grounding. Wires 1200 can be any size, such as for example, from approximately 22 gage to approximately 14 gage.

Connector 1100 can comprise a housing 1110 that can define any number of cages 1300. Each cage 1300 can define a cage opening 1320 at an entrance to a channel 1340 that extends within cage 1300. All of the cage openings 1320 can be co-planar, that is, all of cage openings 1320 can be aligned with a front plane defined by housing 1110 and/or connector 1100, and/or a plane slightly recessed from that front plane.

Disposed substantially within, and/or comprised by, each cage 1300 can be a wire clamping device 1400. In certain exemplary embodiments, the wire clamping device can be implemented as a screw-actuated clamp, which can comprise a rotatable, but non-linearly progressing screw head 1410 that is coupled to a rotatable but non-linearly progressing screw shaft (shown in FIG. 5). Screw-actuated clamp 1400 can also comprise a pair of clamping jaws 1460, 1470, at least one of which can be moved by the rotation of screw head 1410.

One or more wires 1210, 1220 can be coupled to connector 1100 via one or more screw-actuated clamps 1400, such as via a releasable clamping action of screw-actuated clamps 1400. For example, a bare end 1230 of wire 1210, such as an end of wire that has been stripped of insulation 1240, can be terminated by electrical contact within cage 1300, such as electrical contact with one or more jaws of screw-actuated clamp 1400. In certain embodiments, multiple wires can be terminated within a single clamp 1400. For example, a single clamp 1400 can be dimensioned to receive and/or terminate two wires.

An electrically conductive path can be formed from at least a portion of screw-actuated clamp 1400, such as clamping jaw 1470, to a corresponding pin 1500 coupled thereto. A plurality of metallic pins 1500 can be disposed in an alternating proximal-distal relationship with respect to a co-planar plurality of cage openings 1320. That is, a first, third, . . . etc., pin can be disposed relatively closer to the front surface and/or front plane defined by housing 1110 and/or connector 1100, and a second, fourth, . . . etc., pin can be disposed relatively further from the front surface and/or front plane defined by housing 1110 and/or connector 1100, or vice versa.

Pins 1500 can be inserted into corresponding holes located through the PCB and/or soldered to the PCB. Alternatively, pins 1500 can be inserted into a receiving socket mounted on the PCB, or can be integral to the socket and insertable into connector 1100, thereby non-destructively removably connecting connector 1100 and/or wires to the PCB. In either case, the connection of wired connector 1100 to PCB can form an electrically conductive path from the wires to the PCB. The portion of this electrically conductive path that flows through connector 1100 can repeatedly and/or sustainably carry and/or accommodate up to approximately 300 volts and/or up to approximately 10 amps.

As shown, screw heads 1410 can be arranged and/or disposed in an alternating proximal-distal relationship with respect to cage openings 1320 and/or a front surface. That is, a first, third, . . . etc., screw head can be disposed relatively closer to the front surface and/or front plane defined by housing 1110 and/or connector 1100, and a second, fourth, . . . etc., screw head can be disposed relatively further from the front surface and/or front plane defined by housing 1110 and/or connector 1100, or vice versa. Before and after receiving wires in their associated cages, screw heads 1410 can be freely accessible to a screwdriver, such as a flat-bladed and/or Phillips-head screwdriver. In certain exemplary embodiments, a centerline of each of screw heads 1410 can be approximately co-linear.

Figure 4:
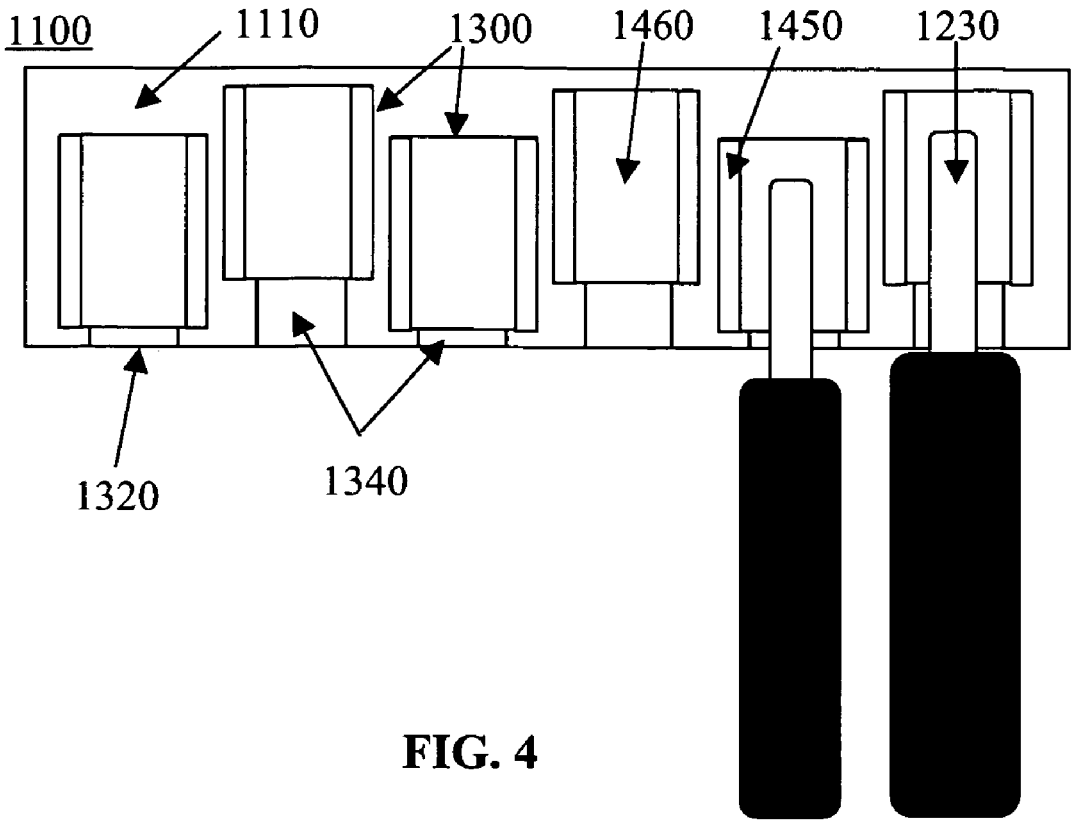
FIG. 4 is a cross-sectional view taken at section A-A of FIG. 2.
Figure 5:
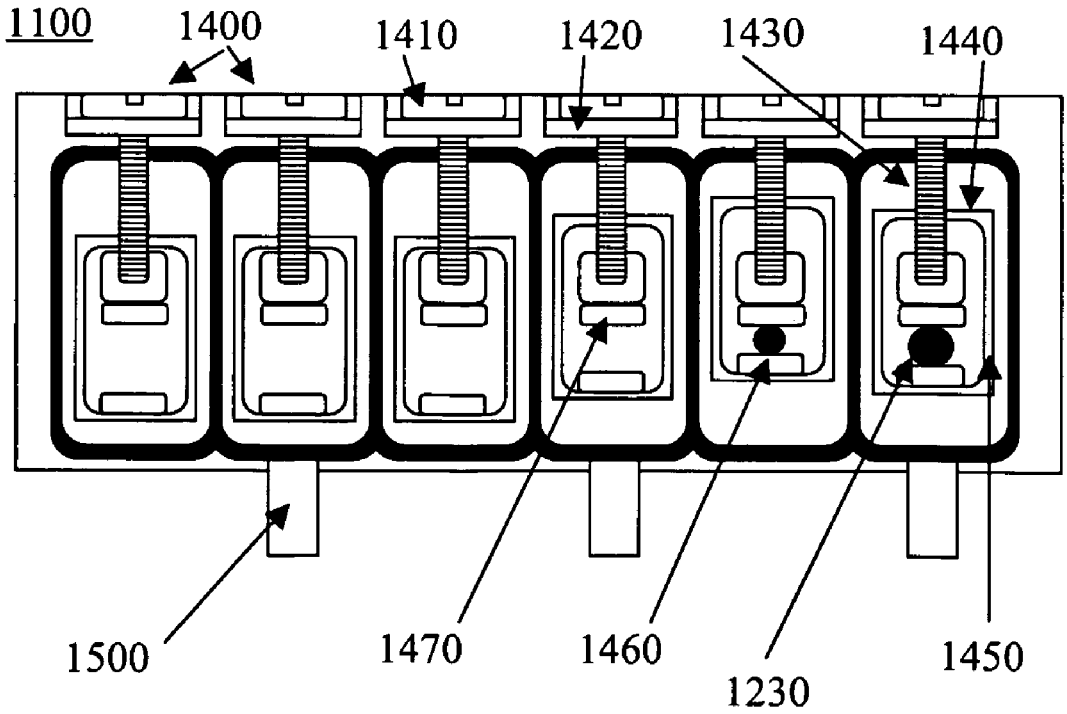
FIG. 5 is a cross-sectional view taken at section B-B of FIG. 3.

FIG. 4 is a cross-sectional view taken at section A-A of FIG. 2, and FIG. 5 is a cross-sectional view taken at section B-B of FIG. 3. As shown, a bare end 1230 of each of wires 1210 and 1220, each of which penetrates cage opening 1320 and resides within channel 1340 that leads within cage 1300.

Screw-actuated clamp 1400 can comprise a screw head 1410, a screw-restraining collar 1420, an axially-restrained screw shaft 1430, a thread follower 1440, one or more sidewalls 1450, a movable clamping jaw 1460, a stationary clamping jaw 1470 opposingly disposed to movable clamping jaw 1460. Collar 1420 and/or a similar mechanism can substantially prevent and/or resist movement of screw head 1410 and/or screw shaft 1430 in a direction parallel to the longitudinal axis of screw shaft 1430 when screw head 1410 and/or screw shaft 1430 is rotated.

Thread follower 1440 can be threaded to substantially match and/or mate with threads of screw shaft 1430. Thread follower 1440 can convert rotation of screw shaft 1430 of screw-actuated clamp 1400 to a linear, up-and-down, and/or back-and-forth motion of sidewalls 1450.

Coupled to sidewalls 1450 can be a movable clamping jaw 1460, which can track the movement of sidewalls 1450. Clamping jaw 1460 and/or clamping jaw 1470 can have a ridged and/or serrated surface to facilitate improved grasping of wire ends 1230.

Screw head 1410, which can be roughly 3.8 millimeters in diameter, can repeatedly and/or sustainably transmit an applied torque of at least about 5 inch-pounds to and/or axially restrained screw shaft 1430, and via interaction with thread follower 1440, that torque can be converted to a force that can move sidewalls 1450, movable clamping jaw 1460, and/or wire ends 1230. When clamped between movable clamping jaw 1460 and stationary clamping jaw 1470, wire ends 1230 can be electrically conductively coupled to pins 1500.

By staggering the locations of screw heads 1410, cages 1300, pins 1500, and/or wire ends 1230, a desired separation distance and/or isolation between screw heads 1410, cages 1300, pins 1500, and/or wire ends 1230 can be maintained and/or larger screw heads and/or screwdriver blades and/or bits can be used. For example, connector 1100 can provide for a pitch and/or center-to-center distance between wire ends 1230, pins 1500, and/or between wire ends 1230 and screw heads 1410, of approximately 4 millimeters. With respect to screw heads 1410 and/or stationary clamping jaws 1470, a single row and/or layer of wires 1200 can be formed via use of connector 1100, thereby potentially facilitating a view of and/or access to connector 1100 and/or an installation, modification, and/or removal of connector 1100 from the PCB and/or one or more wire ends 1230 from connector 1100.

Figure 6:
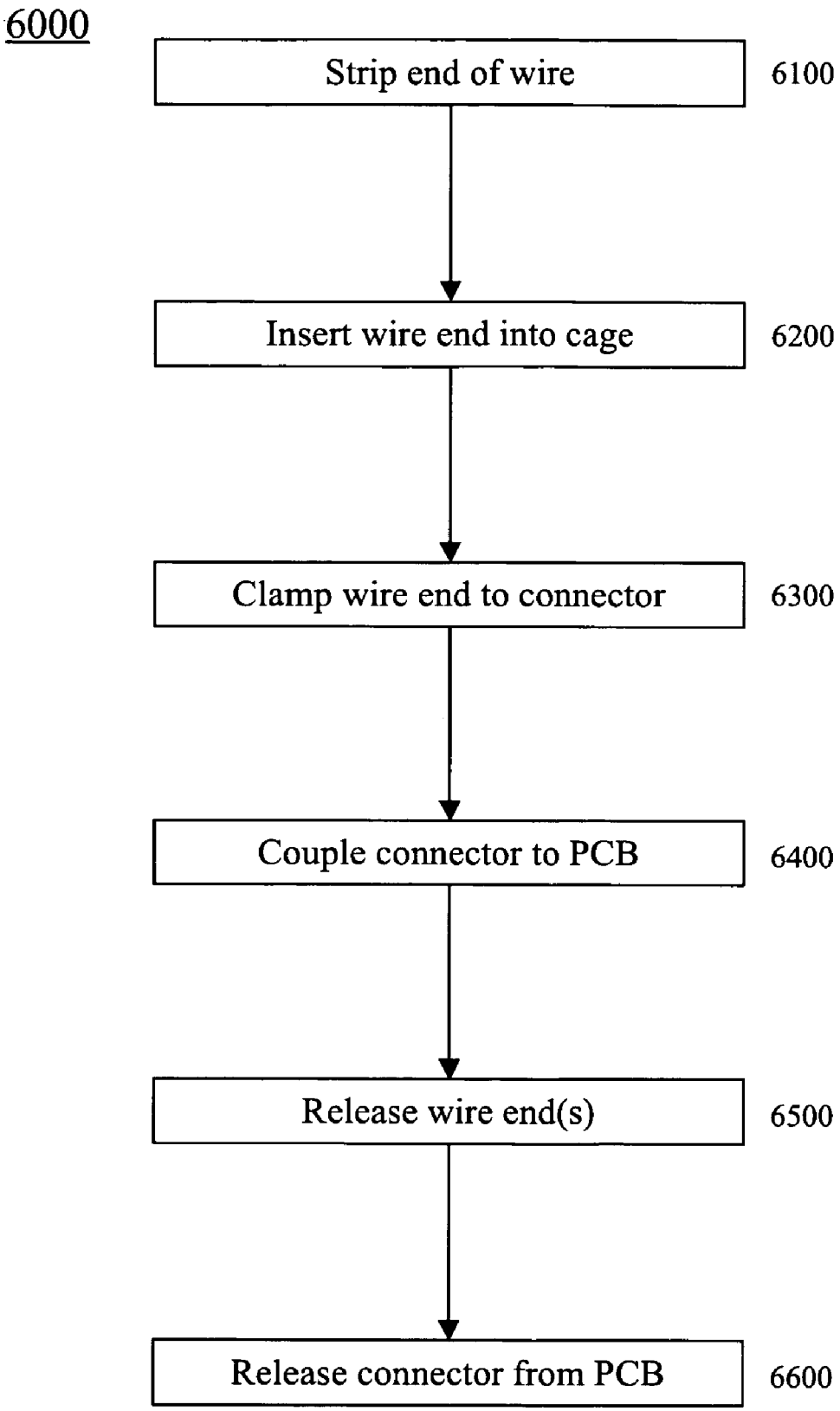
FIG. 6 is a flowchart of an exemplary method 6000.

FIG. 6 is a flowchart of an exemplary method 6000 for electrically coupling one or more wires to a PCB. At activity 6100, a termination end of a wire can be stripped of insulation. At activity 6200, the bare termination end of one or more wires can be inserted through a cage opening and/or into a cage of a housing of a connector. At activity 6300, screw-actuated clamps can be utilized to clamp the termination end of the one or more wires. In certain exemplary embodiments, a plurality of wires can be electrically coupled to a printed circuit board of a programmable logic controller via a connector. The connector can define a plurality of cages. The plurality of cages can define a co-planar plurality of cage openings. The connector can comprise a plurality of screw-actuated clamps. Each of the screw-actuated clamps can be disposed substantially within a corresponding one of the plurality of cages. Each of the screw-actuated clamps can be adapted to receive a termination end of at least one of a plurality of wires' via a corresponding cage opening. Each of the screw-actuated clamps can comprise an axially restrained screw. A movable clamping jaw can be coupled to the screw, and a stationary clamping jaw can be opposingly disposed to the movable clamping jaw. The connector can comprise a plurality of metallic pins disposed in an alternating proximal-distal relationship with respect to the co-planar plurality of cage openings. The plurality of metallic pins can be configured to electrically couple the connector to a printed circuit board of a programmable logic controller At activity 6400, the connector can be coupled to the PCB. At activity 6500, one or more of the termination ends can be released from the corresponding clamp. At activity 6600, the connector can be de-coupled and/or released, perhaps nondestructively, from the PCB.

Figure 7:
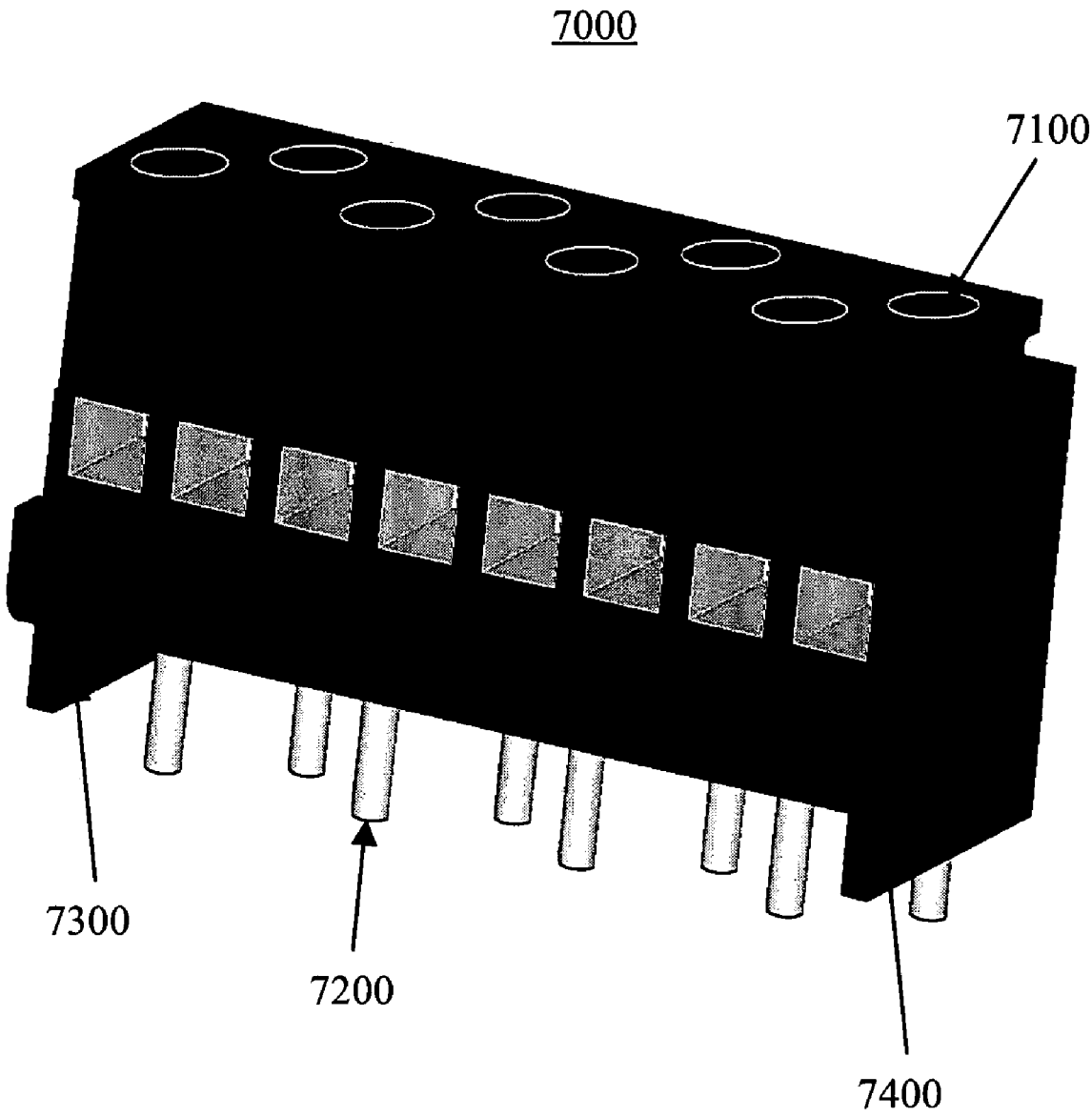
FIG. 7 is a perspective view of an exemplary embodiment of a connector 7000.

FIG. 7 is a perspective view of an exemplary embodiment of a connector 7000, which can comprise a relatively small pitch provided by screws 7100 and pins 7200, each of which can be disposed in an alternating proximal-distal relationship with respect to a co-planar plurality of cage openings.

In certain exemplary embodiments, a pitch of pins 7200 can be approximately four millimeters. Pins 7200 can be staggered to minimize spacing requirements for associated PCB copper pads.

Certain exemplary embodiments can comprise a first plastic standoff 7300 and/or a second plastic standoff 7400 to increase a flow of air along the PCB. First plastic standoff 7300 and/or second plastic standoff 7400 can provide a spacing from the surface of a printed circuit board, which can facilitate air flow adjacent to the printed circuit board. In certain exemplary embodiments, the spacing can be approximately three millimeters.

Figure 8:
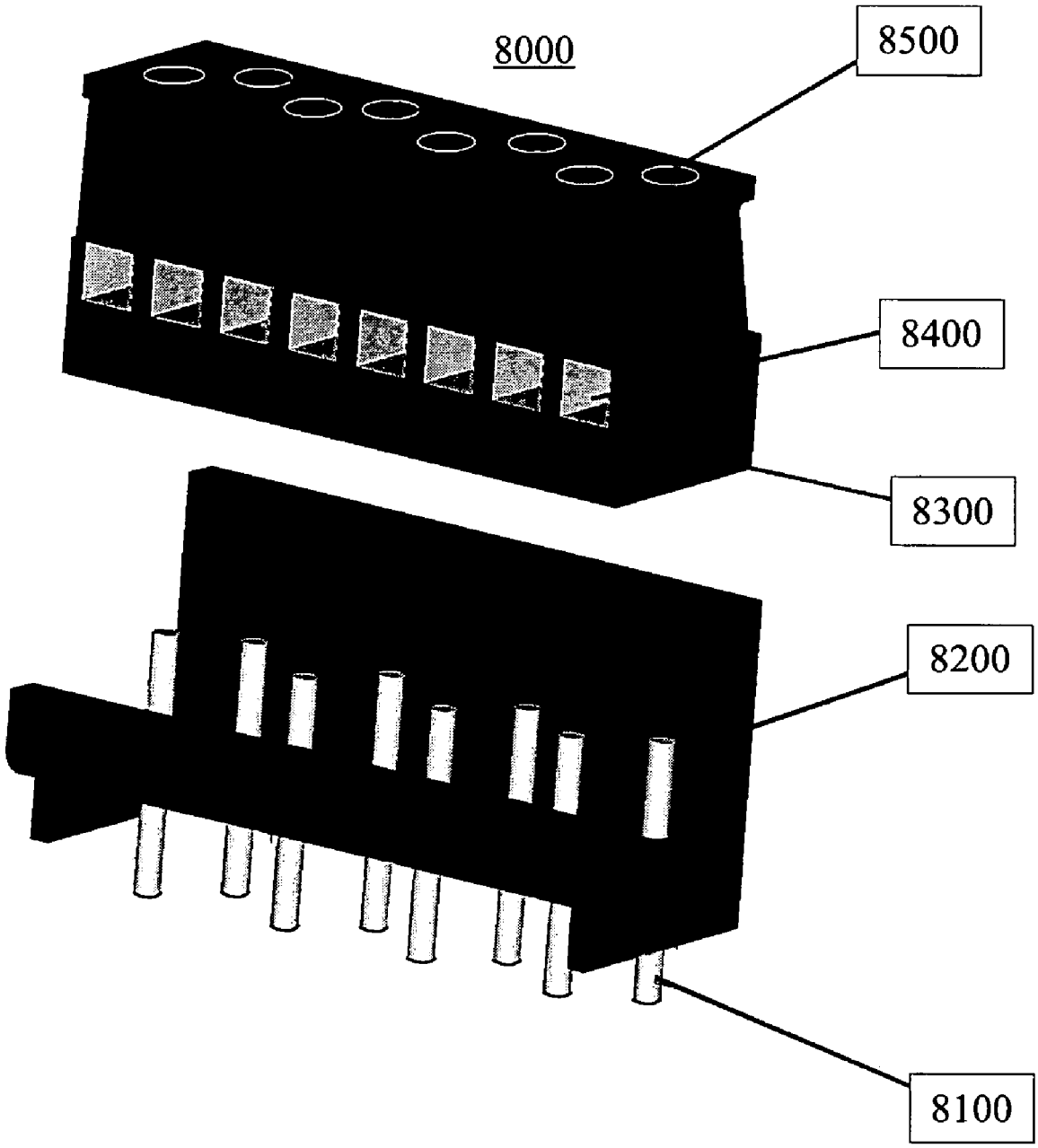
FIG. 8 is an exploded perspective view of an exemplary embodiment of a connector 8000.

FIG. 8 is an exploded perspective view of an exemplary embodiment of a multi-part connector 8000, which can comprise, for example, a base 8200 and a cap 8300, which can releasably and/or snapably mate together via a press fit. Utilizing multiple parts to form connector 8000 can allow:

1. Attachment of wires to cap 8300 without exerting force against the solder joints attaching base 8200 to the PCB;
2. Attachment of wires to cap 8300 at a nearby location that is more accessible (e.g., more convenient for and/or to hands, screwdrivers, wire ends, lighting, viewing, etc.) than one immediately adjacent base 8200; and/or
3. Attachment of wires to cap 8300 at a nearby location that is safer than one immediately adjacent base 8200; etc.

Connector 8000 can define a plurality of cages 8400, which can be metallic wiring cages that can move up and down when a screw 8500 is rotated. Plurality of cages 8400 can define a co-planar plurality of cage openings. In certain exemplary embodiments, a plurality of centerlines defined by a corresponding cage of plurality of cages 8400 can approximately define a single line. In certain exemplary embodiments, a plurality of centerlines defined by a corresponding cage of plurality of cages 8400 can approximately define at least two lines. In certain exemplary embodiments, when each termination end of each of a plurality of wires, configured to be coupled to connector 8000, is disposed within a corresponding cage opening, a screw head associated with each of a plurality of screw-actuated clamps, comprised by connector 8000, can be accessible to a screwdriver (not illustrated).

In certain exemplary embodiments, a plurality of metallic pins 8100 can have a pitch of approximately four millimeters and can be disposed in an alternating proximal-distal relationship with respect to a co-planar plurality of cage openings in the PCB mounting area to minimize a diameter of corresponding copper pads. Plurality of metallic pins 8100 can be configured to electrically couple connector 8000 to a printed circuit board (not illustrated) of a programmable logic controller (not illustrated). In certain exemplary embodiments, connector 8000 can be releasably and/or no-destructively attachable to the printed circuit board. In an embodiment wherein metallic pins 8100 are disposed in an alternating proximal-distal relationship with respect to a co-planar plurality of cage openings, a head of screw 8500 can be larger than in alternative embodiments allowing a larger screwdriver potentially to be utilized in electrically coupling wires within cages 8400. A size of the head of screw 8500 can be based on a wire size that connector 8000 can accept within cages 8400.

Note

Still other practical and useful embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application.

Thus, regardless of the content of any portion (e.g., title, field, background, summary, abstract, drawing figure, etc.) of this application, unless clearly specified to the contrary, such as via an explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

any elements can be integrated, segregated, and/or duplicated;

any activity can be repeated, performed by multiple entities, and/or performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

Accordingly, the descriptions and drawings are to be regarded as illustrative in nature, and not as restrictive.

What is claimed is:

1. A system comprising:

a connector defining a plurality of cages, said plurality of cages defining a co-planar plurality of cage openings, said connector comprising a plurality of screw-actuated clamps, each of said screw-actuated clamps disposed substantially within a corresponding one of said plurality of cages, each of said screw-actuated clamps adapted to receive a termination end of at least one of a plurality of wires via a corresponding cage opening, each of said screw-actuated clamps comprising an axially restrained screw, a movable clamping jaw coupled to each axially restrained screw, and a stationary clamping jaw opposingly disposed to said movable clamping jaw, wherein for said plurality of screw-actuated clamps, a corresponding plurality of screw heads are disposed in an alternating proximal-distal relationship with respect to said co-planar plurality of cage openings, said connector comprising a plurality of metallic pins disposed in an alternating proximal-distal relationship with respect to said co-planar plurality of cage openings, said plurality of metallic pins configured to electrically couple said connector to a printed circuit board of a programmable logic controller.

2. The system of claim 1, wherein a base of said connector comprises a plurality of standoffs configured to facilitate air flow adjacent to said printed circuit board.

3. The system of claim 1, further comprising:

said printed circuit board.

4. The system of claim 1, further comprising:

said programmable logic controller.

5. The system of claim 1, wherein a termination end of each of said plurality of wires is insulation-free.

6. The system of claim 1, wherein at least a portion of each of said plurality of screw-actuated clamps is adapted to be moved with respect to a corresponding wire.

7. The system of claim 1, wherein each of a plurality of centerlines defined by a corresponding cage of said plurality of cages are approximately co-linear.

8. The system of claim 1, wherein all of a plurality of centerlines defined by a corresponding cage of said plurality of cages approximately define at least two lines.

9. The system of claim 1, wherein said plurality of screw-actuated clamps are disposed in an alternating proximal-distal relationship with respect to said co-planar plurality of cage openings.

10. The system of claim 1, wherein, for said plurality of screw-actuated clamps, a corresponding plurality of screw heads are disposed such that a centerline of said plurality of screw heads is approximately co-linear.

11. The system of claim 1, wherein each of said screw-actuated clamps is adapted to releasably attach a corresponding wire of said plurality of wires.

12. The system of claim 1, wherein each of said plurality of metallic pins is adapted to be received in a corresponding socket of said printed circuit board.

13. The system of claim 1, wherein said connector is releasably attachable to said printed circuit board.

14. The system of claim 1, wherein said connector is non-destructively releasably attachable to said printed circuit board.

15. The system of claim 1, wherein each of said screw-actuated clamps is dimensioned to receive a termination end of a plurality of sizes of wires.

16. The system of claim 1, wherein when each termination end of each of said plurality of wires is disposed within said corresponding cage opening, a screw head associated with each of said screw-actuated clamps is freely accessible to a screwdriver.

17. A method comprising:

electrically coupling a plurality of wires to a printed circuit board of a programmable logic controller via a connector, said connector defining a plurality of cages, said plurality of cages defining a co-planar plurality of cage openings, said connector comprising a plurality of screw-actuated clamps, each of said screw-actuated clamps disposed substantially within a corresponding one of said plurality of cages, each of said screw-actuated clamps adapted to receive a termination end of at least one of said plurality of wires via a corresponding cage opening, each of said screw-actuated clamps comprising an axially restrained screw, a movable clamping jaw coupled to each screw, and a stationary clamping jaw opposingly disposed to said movable clamping jaw, wherein for said plurality of screw-actuated clamps, a corresponding plurality of screw heads are disposed in an alternating proximal-distal relationship with respect to said co-planar plurality of cage openings, said connector comprising a plurality of metallic pins disposed in an alternating proximal-distal relationship with respect to said co-planar plurality of cage openings, said plurality of metallic pins configured to electrically couple said connector to said printed circuit board of said programmable logic controller.

18. A device comprising:

a connector defining a plurality of cages, said plurality of cages defining a co-planar plurality of cage openings, said connector comprising a plurality of screw-actuated clamps, each of said screw-actuated clamps disposed substantially within a corresponding one of said plurality of cages, each of said screw-actuated clamps adapted to receive a termination end of at least one of a plurality of wires via a corresponding cage opening, each of said screw-actuated clamps comprising an axially restrained screw, a movable clamping jaw coupled to each screw, and a stationary clamping jaw opposingly disposed to said movable clamping jaw, wherein for said plurality of screw-actuated clamps, a corresponding plurality of screw heads are disposed in an alternating proximal-distal relationship with respect to said co-planar plurality of cage openings, said connector comprising a plurality of metallic pins disposed in an alternating proximal-distal relationship with respect to said co-planar plurality of cage openings, said plurality of metallic pins configured to electrically couple said connector to a printed circuit board of a programmable logic controller, said connector comprising a cap.

* * * * *